US012084880B1

(12) United States Patent
Lebrija

(10) Patent No.: US 12,084,880 B1
(45) Date of Patent: Sep. 10, 2024

(54) FLEXIBLE FENCE WIRE RETENTION SYSTEM

(71) Applicant: Roberto Lebrija, Torrington, WY (US)

(72) Inventor: Roberto Lebrija, Torrington, WY (US)

(73) Assignee: RRM Composites LLC, Torrington, WY (US)

( * ) Notice: Subject to any disclaimer, the term of this patent is extended or adjusted under 35 U.S.C. 154(b) by 0 days.

(21) Appl. No.: 18/454,627

(22) Filed: Aug. 23, 2023

(51) Int. Cl.
*E04H 17/10* (2006.01)

(52) U.S. Cl.
CPC ..... *E04H 17/124* (2021.01)

(58) Field of Classification Search
CPC ..... E04H 17/02; E04H 17/04; E04H 17/05; E04H 17/06; E04H 17/10; E04H 17/12; E04H 17/124; E04H 17/127; E04H 17/131; E04H 17/1456
See application file for complete search history.

(56) References Cited

U.S. PATENT DOCUMENTS 211,139 A * 1/1879 Erb ..... E04H 17/131 256/47
533,334 A * 1/1895 Yakley ..... E04H 17/124 256/44
4,369,953 A * 1/1983 Greiner ..... E04H 17/143 256/73
5,702,090 A * 12/1997 Edgman ..... E04H 17/1426 256/65.02
6,679,480 B1 * 1/2004 Hara ..... E04H 17/124 256/37
7,198,253 B2 * 4/2007 Striebel ..... E04F 11/1834 403/275
8,266,803 B2 * 9/2012 Neusch ..... E04H 17/127 29/897
9,249,577 B2 * 2/2016 Ross ..... F16G 11/04
10,221,522 B1 * 3/2019 Henderson ..... E04F 11/1859
10,400,402 B1 * 9/2019 Sanders ..... E01F 8/0029
11,053,707 B2 * 7/2021 Lebrija ..... E04H 17/1417
2015/0021533 A1 * 1/2015 Johnson ..... E04H 17/127 256/37
2017/0058557 A1 * 3/2017 Wu ..... E04H 17/22

FOREIGN PATENT DOCUMENTS

DE 19919631 A1 * 11/2000 ..... E04H 17/10
DE 202020107451 U1 * 3/2021
EP 0258585 A2 * 9/1988
FR 3080397 A1 * 10/2019 ..... A01K 1/0017
JP 5279073 B2 * 9/2013

(Continued)

*Primary Examiner* — Jonathan P Masinick
(74) *Attorney, Agent, or Firm* — Michael L. Greenberg, Esq.; Greenberg & Lieberman, LLC

(57) ABSTRACT

A modular flexible fencing system, configured for installation by a novice without special tools, equipped with a novel flexible fencing material retention system which employs caged receivers that interface with spring-equipped auto-tensioning inserts disposed on the termini of each instance of flexible fencing material. The auto-tensioning inserts ensure that adequate tension is applied to the flexible fencing material with minimal adjustment. U-shaped posts are equipped with a slot that ensures the caged receivers are secured within the posts at the desired positions. Screws further ensure that the caged receivers are mounted in place securely.

5 Claims, 9 Drawing Sheets

(56) References Cited

FOREIGN PATENT DOCUMENTS

| | | | | | |
|---|---|---|---|---|---|
| KR | 100831568 | B1 | * | 5/2008 | |
| KR | 100893175 | B1 | * | 4/2009 | |
| KR | 20110009003 | U | * | 9/2011 | |
| KR | 101104124 | B1 | * | 1/2012 | |
| KR | 101209902 | B1 | * | 12/2012 | |
| WO | WO-2015160101 | A1 | * | 10/2015 | ..... E04H 17/02 |

* cited by examiner

FLEXIBLE FENCE WIRE RETENTION SYSTEM

FIELD OF THE PRESENT INVENTION

The present invention relates to the field of exterior fencing, and more specifically relates to a new system by which flexible fence structures, including, but not limited to rope, welded wire, steel cable, and others, are installed and retained. The system is configured to automatically apply the desired tension to the cables and facilitate easy installation by a novice.

BACKGROUND OF THE PRESENT INVENTION

There are many types of fences presently available on the market. In instances where a privacy fence is not desired, flexible fencing structures are often erected. These fences employ wires, ropes, or cables instead of horizontal or vertical boards. Often, such fences are used for safety, such as along a dock, animal confinement, or for aesthetics.

Unfortunately, most individuals that may wish to install such a fence do not often have the expertise required to adequately erect the fence while ensuring that the posts remain perpendicular to the ground, and that the flexible material (wire, rope, etc.) maintains an adequate tension which is equal across all sections of the fence.

Flexible materials for fences have been used for a long time. There are two premises for this type of materials for implementation into a fence: 1) Traditional system require several parts and hardware that connection the flexible materials to the rigid vertical posts. Most systems are difficult to install, and require special tooling. 2) Additionally, traditional systems rely on the initial tension the installer gives to the materials, as the goal is to ensure adequate tension to the flexible materials between posts. In many cases, the tension will suffer with time based on several factors, including material fatigue and natural changes of the terrain.

If there were a way in which the novice could install a flexible fence without special tools and experience in the field, while ensuring optimal installation, flexible fence installation would be faster and easier.

Thus, there is a need for a new system by which flexible fences may be installed. Such a system preferably employs specialized brackets, referenced as caged receivers, to safely and easily contain and restrain the flexible fencing material (wire, marine rope, steel cable, etc.) within the posts. Auto-tensing inserts are preferably employed to maintain the ideal tension of the fencing material to ensure a homogeneous appearance between fencing sections upon completion.

Some existing flexible fencing systems found in the prior art have problems with their implementation. The following patents are related solely to cable fencing. They do not provide a solution on how to keep erect and tense flexible materials besides cables. In short, in contrast to the present invention, the following systems are not configured for use with metal or plastic mesh that is shipped in rolls, fabric screens generally composed of nylon, or ivy screens that simulate plants (also shipped in rolls).

Gim Sanh Uh (KR1167553B1) teaches a flexible fence apparatus. However, unlike the system of the present invention, Sanh Uh employs tensioners that extend beyond the post (i.e. go all the way through the post). The present invention employs auto-tensioning inserts which functions to apply tension to the flexible fencing material from within the post itself, providing a means by which the posts may be positioned next to walls or other retaining elements common in fencing where a fence usually starts or ends at a property boundary. Further, the fencing modules of the present invention can be positioned back-to-back for a line post, or at 45-degrees for the fence to continue at a different direction. Cables at a second or following section/module can run at the same horizontal level as the first. The internal ere3cting and auto-tensioning apparatus of the present invention permits use of other flexible fencing materials between posts because the U-shape of the posts of the present invention provides enough space for a screen or for the flexible material to end inside the post(s). Further, the multiple caged receivers permit several ways to provide tension and erect other flexible materials other than cables.

Thaddeus Constantine (US344576A) teaches a flexible fencing system similar to that of Gim Sanh Uh, exhibiting similar drawbacks. Namely, the tensioning system employed extends beyond the perimeter of the posts, and is suitable solely for wire/cable fencing, unlike the present invention. Further, the system taught by Constantine requires that the tensioning mechanism be adjusted and crimped by the installed because the post has holes through which the cables pass. As such, the tensioning mechanism of Constantine must be installed from the outside of the posts, after the cable passes through the hole, unlike the present invention.

Matsuda Yasuo (JP05279073B2) teaches a flexible fencing system which employs a tensioning apparatus which is attached to the cable within the spacing between posts. It is attached to the outside of a non-structural post, and attached to a structural posts. The two posts are attached by a hardware piece on the top and bottom. This design creates the following problems: only cables can be used as the flexible fencing material; the tensioning device is exposed within the space between posts, affecting the desired clean look of a cable product; the required non-structural posts, attached to a structural post causes installation difficulties and increases the cost of implementation; the structural post does not integrate the tensioning mechanism. Additionally, the system taught by Matsuda requires the tensioning mechanism to be adjusted and crimped by the installer as the post has holes through which the cable passes, ensuring that the tensioning mechanism must be installed from the exterior of the post, after the tensioning mechanism is inserted through the hole of the post(s), unlike the present invention.

Kim Tak Su (KR990835B1) teaches a flexible fencing system with similar problems. Namely, the posts are equipped with holes through which the cables must pass, requiring the tensioning mechanism to be installed from outside of the post after the mechanism is passed through the hole. Further, Kim Tak Su teaches the use of a ground mechanism which requires the ground to be level and clear between the posts, unlike the present invention.

SUMMARY OF THE PRESENT INVENTION

The present invention is a system configured to facilitate and expedite the installation of flexible fences outdoors. The system employs a specially designed caged receiver, disposed within each post, which is configured to securely hold an auto-tensing insert disposed in communication with the flexible fencing material. Each flexible fencing material instance (i.e. each wire, each rope, welded wire, hardware cloth, etc.) of the fence is tethered to two caged receivers, each on opposite posts. Further, each flexible fencing material instance is terminated (on both ends) with auto-tensing inserts which are configured to mate with the caged receivers. Each auto-tensing insert is equipped with a spring which facilitates the automatic tensing of the flexible fence material instance.

The auto-tensioning insert is specially designed to fit within a first slot of the caged receiver. The caged receiver is sized specifically such that it fits snugly within a U-shaped channel of the post, ensuring a flush appearance from all sides of the post. As such, unlike other flexible fencing systems present on the market, the tensioning mechanism of the present invention is disposed within the post itself, and therefore does not protrude out and away from the opposite side of the post. The caged receivers are equipped with a vertical brace having a curved top portion which extends up and back towards a vertical rear panel to ensure that the auto-tensioning insert remains firmly in position within the caged receiver.

Since flexible materials are not rigid, it can be difficult to use them as fences. The current products on the market that use flexible materials require many parts, and installing them is mostly suited for professionals since special tools are required to create the tension required to keep the fence erect and provide permanent attachment to the vertical posts. In contrast, the design of the present invention permits the use of flexible materials, including steel cables, welded wire mesh, chain link mesh, marine ropes, fence screens, faux ivy plastic screens and other flexible materials to be used on a modular fence that can be used for many applications.

The following brief and detailed descriptions of the drawings are provided to explain possible embodiments of the present invention but are not provided to limit the scope of the present invention as expressed herein this summary section.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

The present invention will be better understood with reference to the appended drawing sheets, wherein.

DETAILED DESCRIPTION OF THE PREFERRED EMBODIMENT

The present specification discloses one or more embodiments that incorporate the features of the invention. The disclosed embodiment(s) merely exemplify the invention. The scope of the invention is not limited to the disclosed embodiment(s).

References in the specification to "one embodiment," "an embodiment," "an example embodiment," etc., indicate that the embodiment described may include a particular feature, structure, or characteristic, but every embodiment may not necessarily include the particular feature, structure or characteristic. Moreover, such phrases are not necessarily referring to the same embodiment, Further, when a particular feature, structure, or characteristic is described in connection with an embodiment, it is submitted that it is within the knowledge of one skilled in the art to affect such feature, structure, or characteristic in connection with other embodiments whether or not explicitly described.

The present invention is a fence module (10) for flexible materials (20) with an erecting and auto-tensioning apparatus. The modules (10) can be made to different lengths depending on consumer preferences, and final adjustment on the length can also be done by a novice using a screwdriver. This final adjustment is common when several modules are used to create a line fence and a final module must be adjusted to a specific length.

Figure 8:
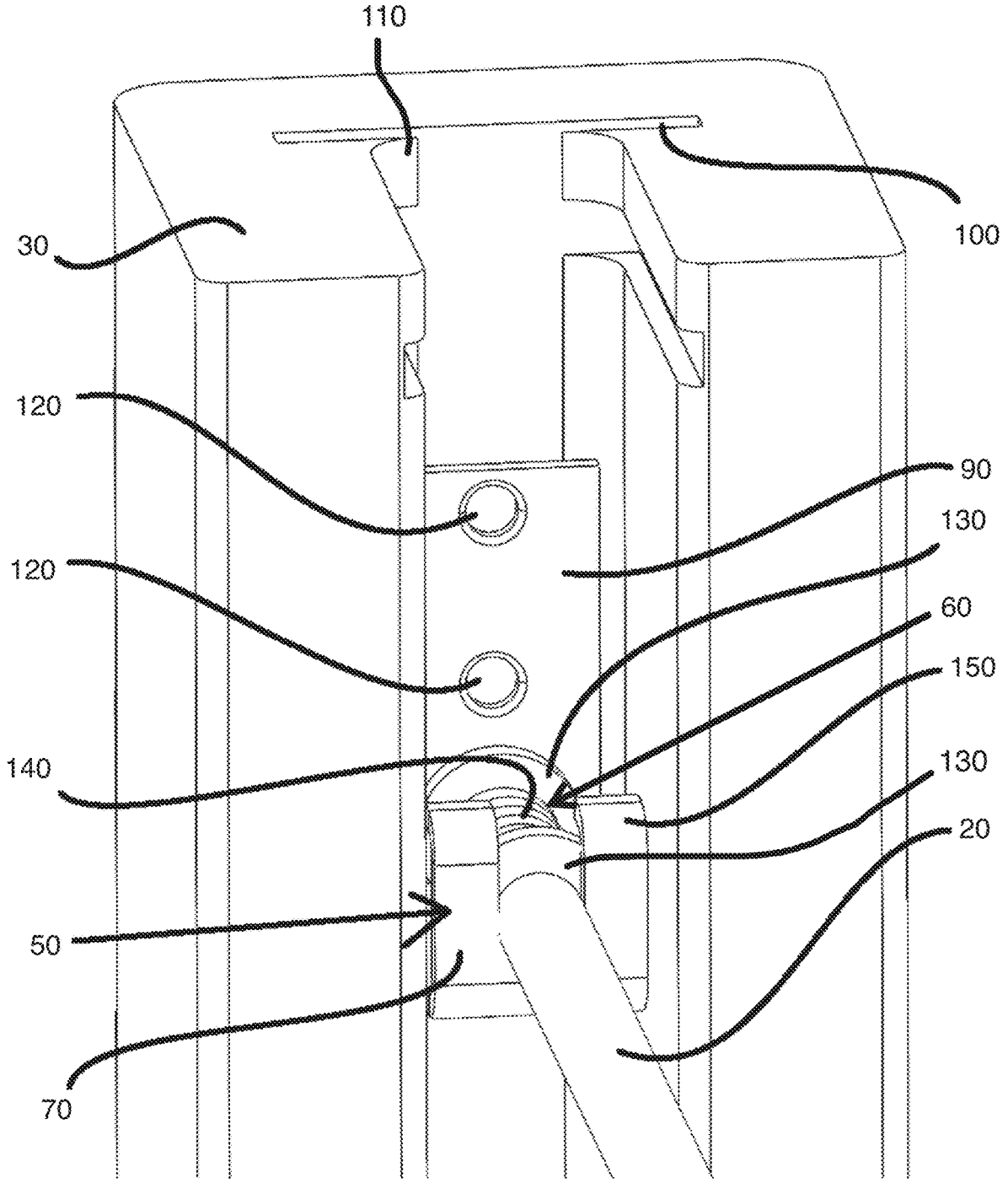
FIG. 8 depicts the caged receiver, disposed in communication with the insert of the flexible material instance, assembled in the U-shaped post of the present invention, as seen from the side.

The present invention employs flexible materials (20) which are held in place at the ends of each instance of the flexible materials (20) by supporting vertical U-shaped rigid posts (30) via caged receivers (50) interfacing with auto-tensioning inserts (60). The caged receivers (50) are equipped with a vertical brace (70) which is equipped with a first slot (80) through with the auto-tensioning insert (60) passes. The flexible material (20) remains in position within the first slot (80) via the auto-tensioning insert (60), which is wider than the first slot (80). The vertical brace (70) ensures that the flexible material may not be accidentally removed from the caged receiver (50). The caged receivers (50) are also equipped with a rear vertical panel (90) which is configured to fit within a U-shaped channel (110) of the post (30) in a vertical position as shown in FIG. 8. Screw holes (120) are present on the rear vertical panel (90) to facilitate attachment of each caged receiver (50) to each post (30). A second slot (100), present within the U-shaped channel (110) of the post (30) is configured to accept an installation gauge (170) which helps the installer to ensure the correct distance between posts is achieved before installing the flexible fencing material (20) between the posts.

Figure 3:
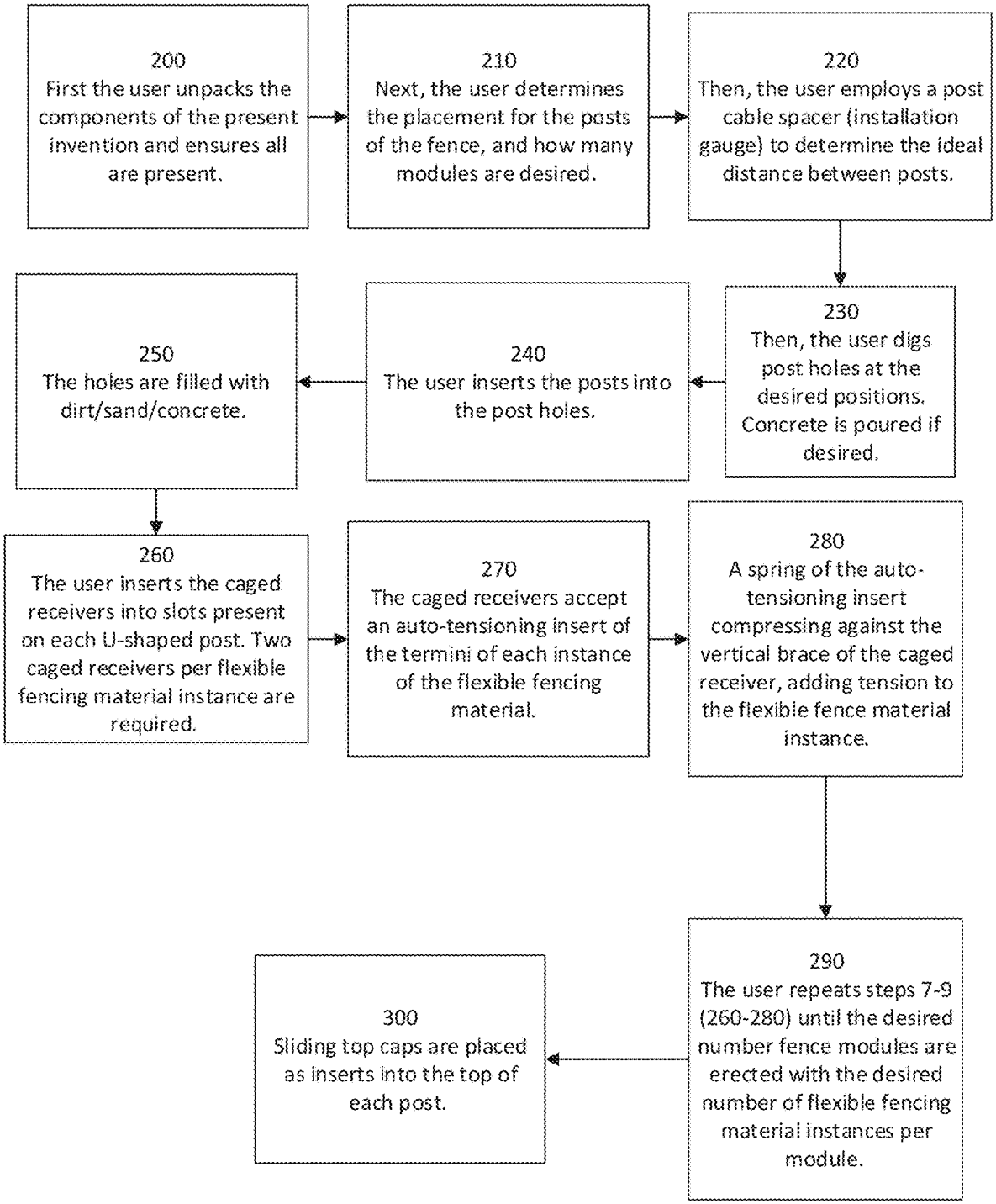
FIG. 3 exhibits a flow chart detailing the process of use of the apparatus of the present invention by a user.
Figure 9:
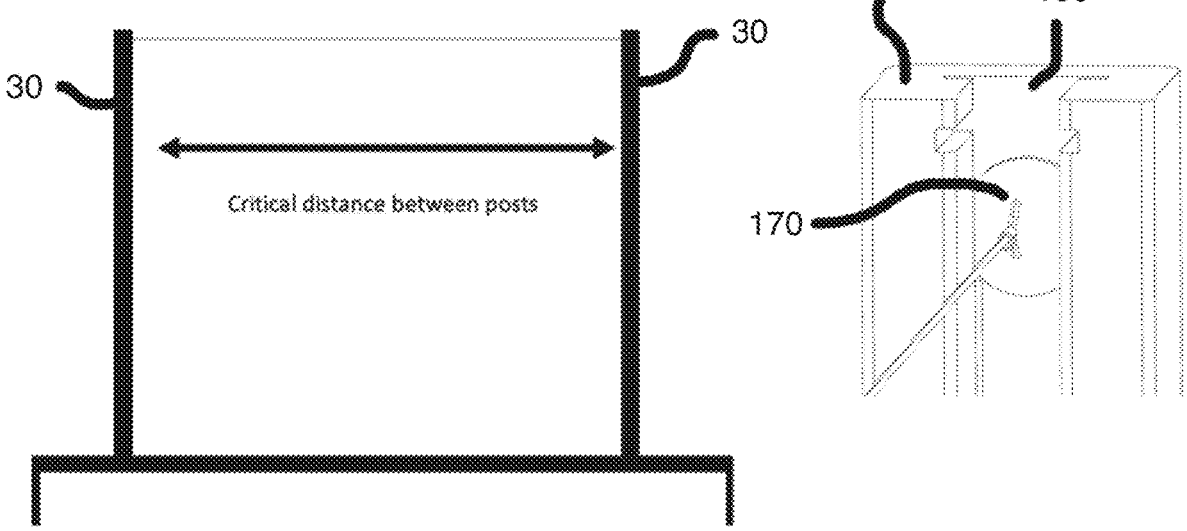
FIG. 9 shows a view of the post-cable spacer (installation gauge) of the present invention in use to indicate to the user the optimal distance between posts for the installation.

As outlined in FIG. 3, the process of use of the apparatus of the present invention by a user is preferably as follows:

1. First the user unpacks the components of the present invention and ensures all are present. (200)
2. Next, the user determines the placement for the posts of the fence, and how many modules are desired. (210)
3. Then, the user employs a post cable spacer (installation gauge) to determine the ideal distance between posts. (220) The installation gauge (170) can be seen in FIG. 9.
4. Then, the user digs post holes at the desired positions. Concrete is poured if desired. (230)
5. The user inserts the posts into the post holes. (240)
6. The holes are filled with dirt/sand/concrete. (250)
7. The user inserts the caged receivers into slots present on each U-shaped post. Two caged receivers per flexible fencing material instance are required. (260) The caged receivers are preferably screwed into place once the desired position is achieved.

Figure 5:
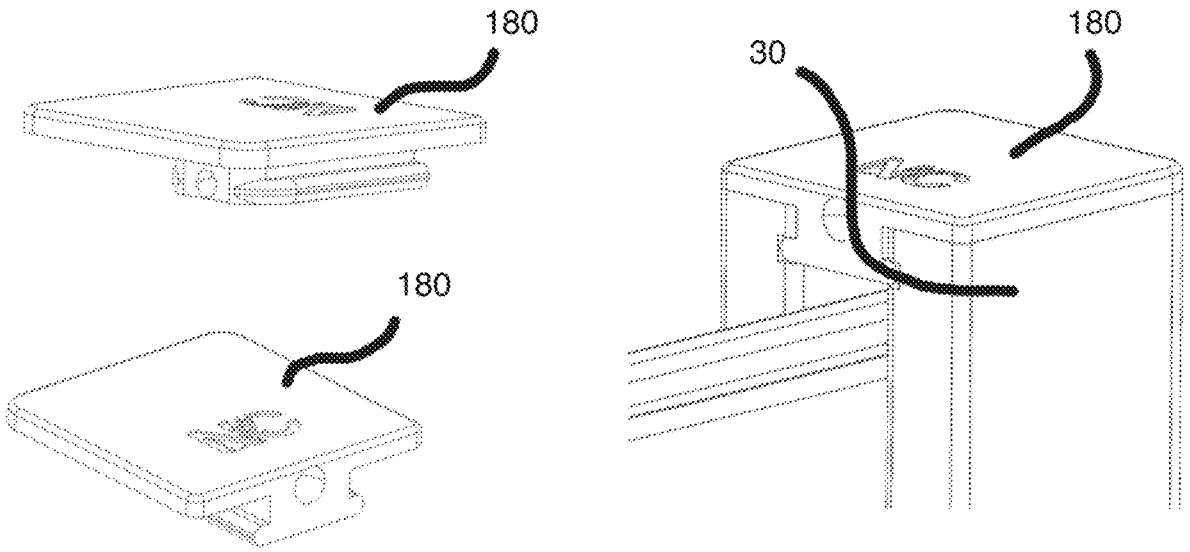
FIG. 5 depicts a sliding top cap configured to fit atop the post(s) of the present invention as seen from the side.
Figure 6:
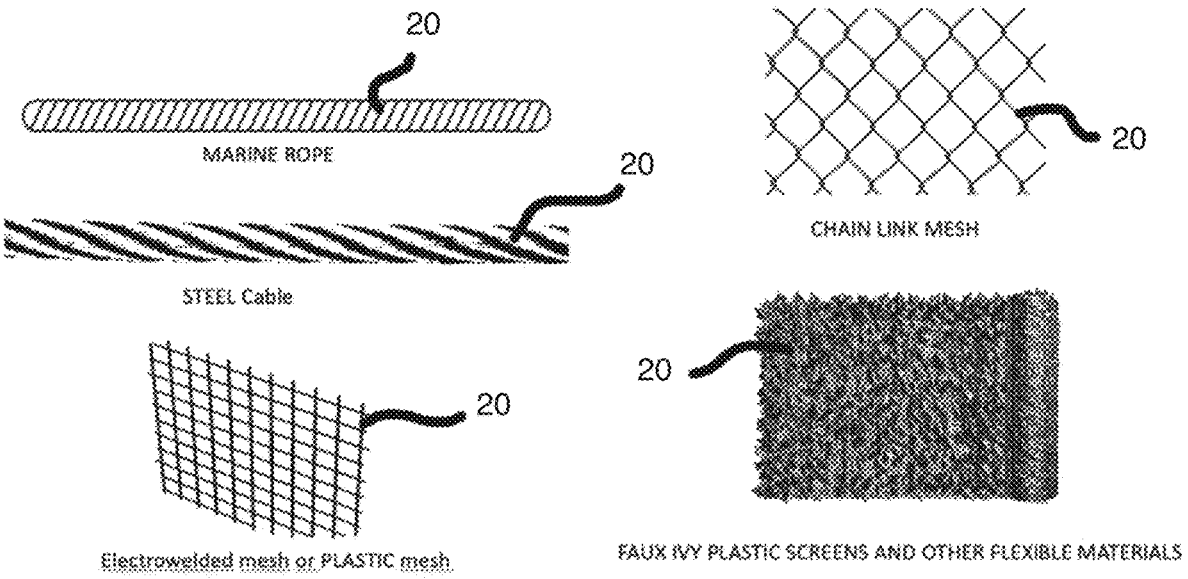
FIG. 6 depicts an assortment of flexible materials suitable for use with the system of the present invention in the installation of a flexible fence.
Figure 7:
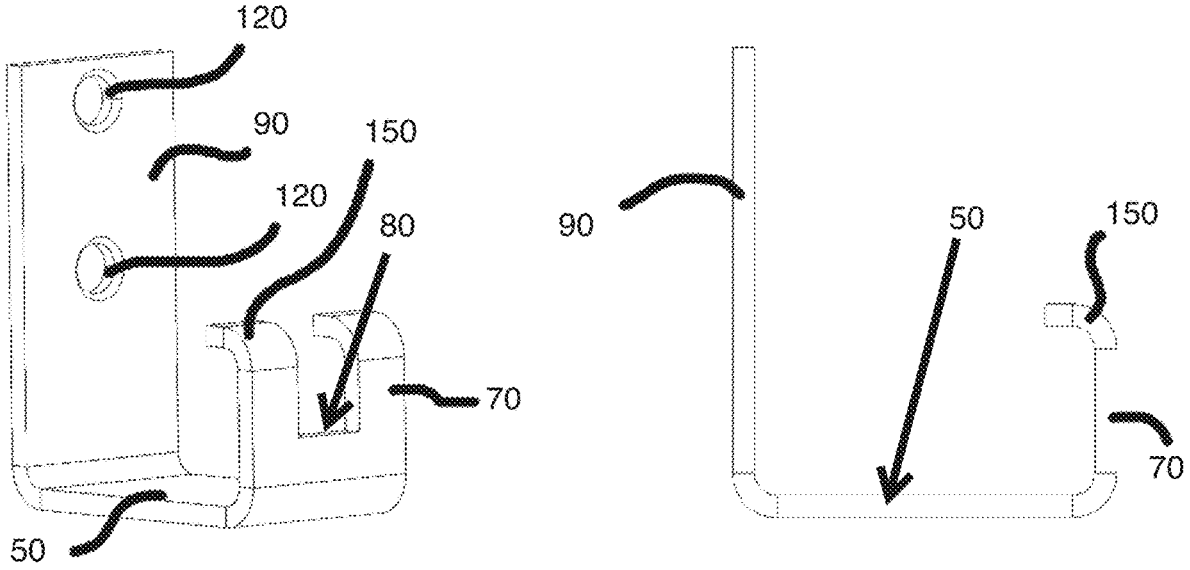
FIG. 7 shows a view of the caged receiver of the present invention.

8. The caged receivers accept an auto-tensioning insert of the termini of each instance of the flexible fencing material. (270) The auto-tensioning inserts are disposed within the first slot of the caged receivers.
9. A spring of the auto-tensioning insert compressing against the vertical brace of the caged receiver, adding tension to the flexible fence material instance. (280)
10. The user repeats steps 7-9 (260-280) until the desired number fence modules are erected with the desired number of flexible fencing material instances per module. (290)
11. Sliding top caps are placed as inserts into the top of each post. (300) The sliding top caps (180) can be seen in FIG. 5.

Figure 1:
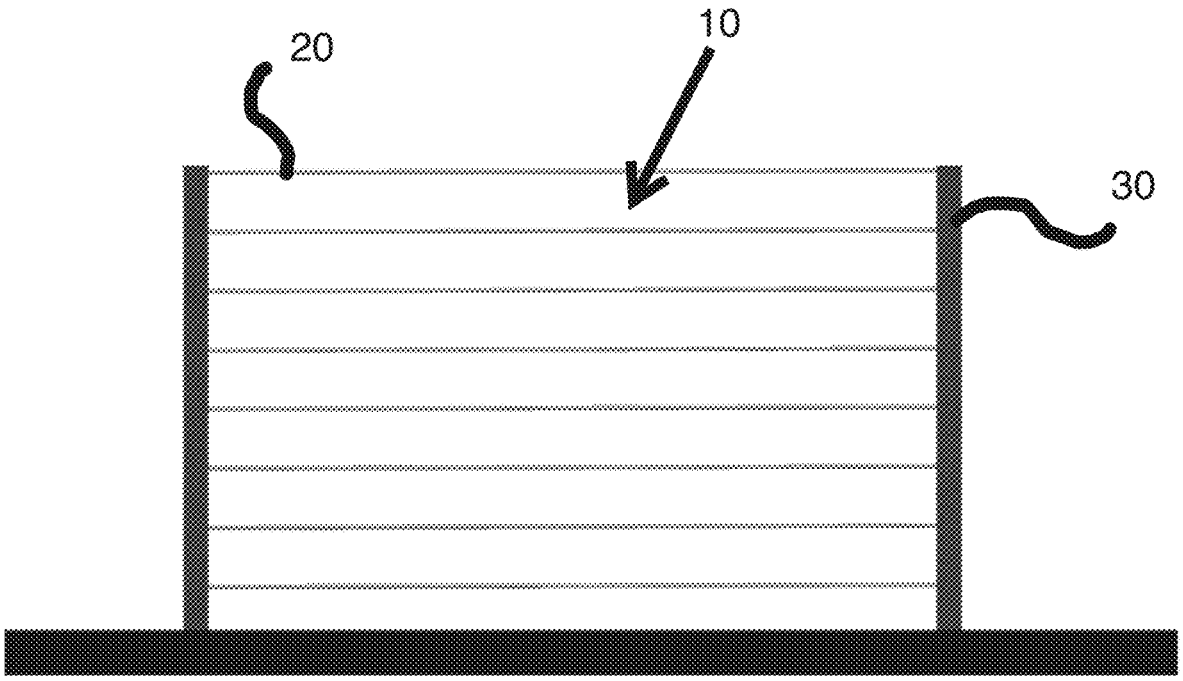
FIG. 1 details a view of a preferred embodiment of the flexible fence system, erected and shown as a single fencing module.
Figure 2:
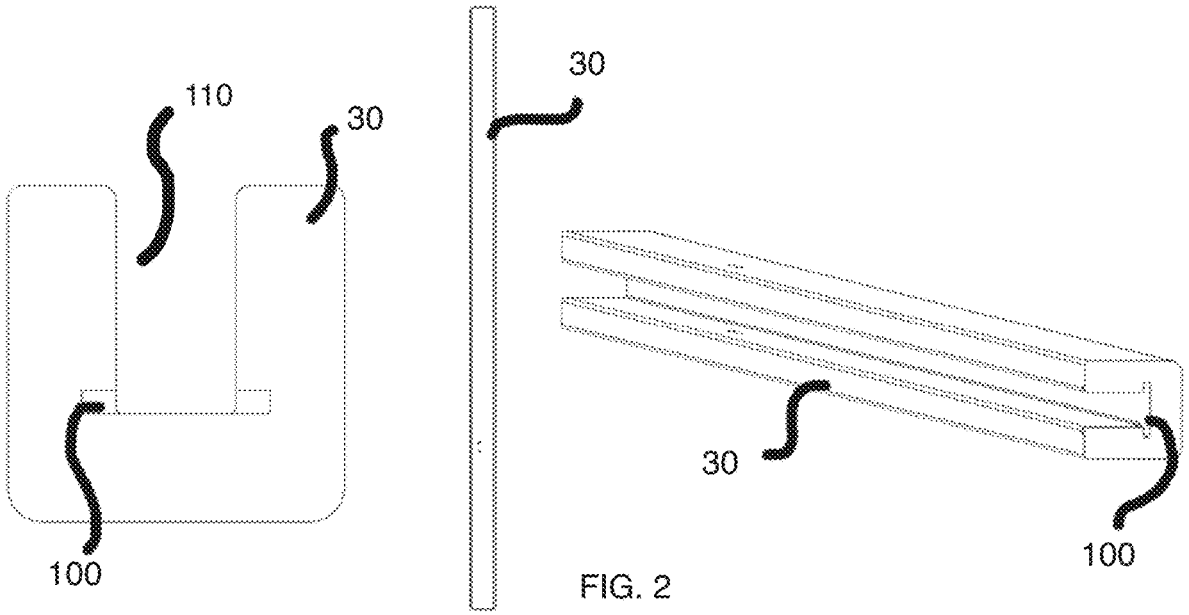
FIG. 2 depicts a view of the U-shaped post of the system of the present invention, shown from the side.

It should be noted that alternate embodiments of the present invention may exhibit different colors, textures, and patterns depicted in the fencing modules that may differ from that shown in FIG. 1. Further, alternate embodiments of the present invention may exhibit longer or shorter flexible materials (20) than those shown in FIG. 1.

Figure 4:
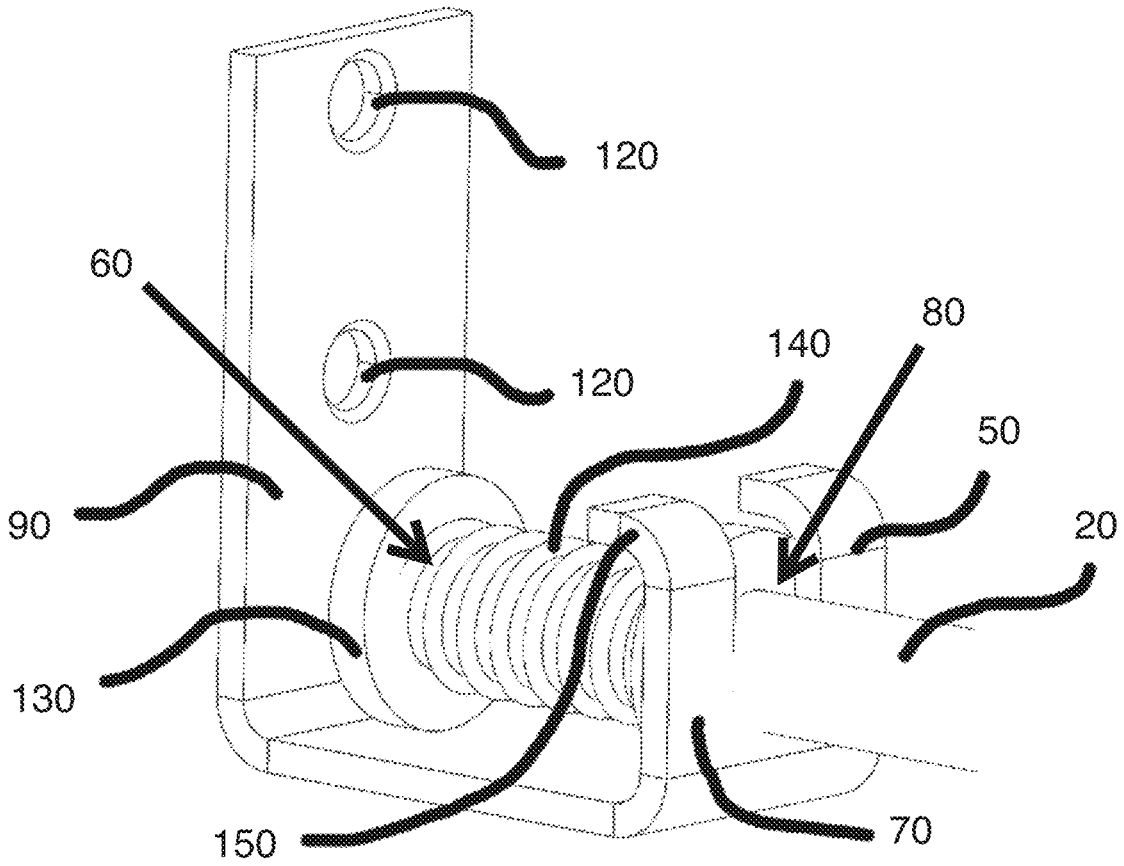
FIG. 4 depicts a view of the caged receiver and insert of the system of the present invention as seen from the side.

It should be understood that each caged receiver (50) is equipped with a first slot (80) through which the auto-tensioning insert (60) disposed in fixed communication with the flexible material (20) passes. Washers (130), or similar circular element, are preferably present in front of, as well as behind the spring (140) of the auto-tensioning insert (60) as shown in FIG. 4. Further, it should be noted that there is no limit to the number of instances of flexible material (20) employed in the construction of the fencing panels (10) of the present invention, but that each instance of flexible material (20) requires two auto-tensioning inserts (60) and two caged receivers (50). Further, it should be noted that the caged receiver (50) of the present invention is equipped with a curved top portion (150) (exhibiting tongs or 'legs') which is configured to ensure that the auto-tensioning insert (60), when disposed in the first slot (80), is maintained in the correct position within the caged receiver (50) even at high tension and differing pulling angles.

It should be understood that the caged receivers (50) of the present invention exhibit a unique design which permits the insertion of the pre-assembled auto-tensioning inserts (60) without the disassembly of any components of the posts (30) based on the design of the caged receivers (50), especially the first slot (80) through which the auto-tensioning insert (60) passes, and the curved top portion (150) which prevents the auto-tensioning insert (60) from losing its seated position within the first slot (80) even when great tension is applied. The caged receivers (50) are also designed to provide enough space for the washers (130), otherwise referenced as limiters, that are placed on both ends of the spring (140). Without this space available, the auto-tensioning inserts (60) would not function correctly. This is in contrast with previous inventions found in the prior art, which do not exhibit such spacing, and instead force the tensioners employed to be positioned, and to function, from outside of the posts. Further, it should be understood that the washers (130) function as limiters of the auto-tensioning insert, facilitating the compression of the spring (140) to maintain tension against the vertical brace (70). Once inserted, the auto-tensioning insert (60) remains in position, and the curved top portion (150) guarantees that when a force hits the cables and pulls on the washers (130), the spring (140) is compressed and the auto-tensioning insert (60) does not slip out of the first slot (80) of the caged receiver (50).

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. A flexible fencing system comprising:

posts, said posts equipped with a U-shaped channel extending from a top of said posts to a bottom of said posts;

flexible fencing material, said flexible fencing material equipped with auto-tensioning inserts, said auto-tensioning inserts disposed on a first end and a second end of said flexible fencing material;

caged receivers, said caged receivers configured to receive said auto-tensioning inserts; and wherein said caged receivers are disposed in fixed communication with said posts;

wherein said caged receivers are each equipped with a vertical brace having a vertical slot centrally disposed on said vertical brace;

wherein said caged receivers are equipped with a curved top portion extending from said vertical brace, configured to maintain said auto-tensioning insert in position within said slot.

2. A flexible fencing system comprising:

posts, said posts equipped with a U-shaped channel extending from a top of said posts to a bottom of said posts;

flexible fencing material, said flexible fencing material equipped with auto-tensioning inserts, said auto-tensioning inserts disposed on a first end and a second end of said flexible fencing material;

caged receivers, said caged receivers configured to receive said auto-tensioning inserts;

wherein said caged receivers are disposed in fixed communication with said posts;

wherein said flexible fencing material is at least one of the following types of flexible fencing material: steel cables, welded wire mesh, chain link mesh, marine ropes, fence screens, and faux ivy plastic screens;

wherein said caged receivers are each equipped with a rear vertical panel, said rear vertical panel having at least one screw hole;

wherein said rear vertical panel is sized to fit within said U-shaped channel of said posts;

wherein said caged receivers are each equipped with a rear vertical panel, said rear vertical panel having at least one screw hole;

wherein said rear vertical panel is sized to fit within said U-shaped channel of said posts;

screws, said screws retaining said caged receivers to said posts via said at least one screw hole disposed in said rear vertical panel of said caged receivers;

a spring, said spring disposed on said auto-tensioning insert;

washers, said washers disposed on ends of said spring;

wherein said flexible fencing material is bonded to said auto-tensioning inserts;

wherein said spring is compressed when force is applied to said flexible fencing material, maintaining tension of said flexible fencing material without permitting said flexible fencing material from breaking or becoming severed from said caged receiver; and wherein said spring supplies consistent tension to said flexible fencing material.

3. A flexible fencing system comprising:

posts, said posts equipped with a U-shaped channel extending from a top of said posts to a bottom of said posts;

flexible fencing material, said flexible fencing material equipped with auto-tensioning inserts, said auto-tensioning inserts disposed on a first end and a second end of said flexible fencing material;

caged receivers, said caged receivers configured to receive said auto-tensioning inserts;

wherein said caged receivers are disposed in fixed communication with said posts;

wherein said caged receivers are each equipped with a vertical brace having a vertical slot centrally disposed on said vertical brace;

wherein said caged receivers are each equipped with a rear vertical panel, said rear vertical panel having at least one screw hole;

wherein said rear vertical panel is sized to fit within said U-shaped channel of said posts;

wherein said caged receivers are equipped with a curved top portion extending from said vertical brace, configured to maintain said auto-tensioning insert in position within said slot;

wherein said auto-tensioning inserts are configured to be installed to the caged receivers without disassembly, and without extending said flexible fencing materials through said posts; and screws, said screws retaining said caged receivers to said posts via said at least one screw hole of said rear vertical panel.

4. The system of claim 3, wherein said flexible fencing material is at least one of the following types of flexible fencing material: steel cables, welded wire mesh, chain link mesh, marine ropes, fence screens, and faux ivy plastic screens.

5. The system of claim 4, further comprising:

a spring, said spring disposed on said auto-tensioning insert;

washers, said washers disposed on ends of said spring;

wherein said flexible fencing material is bonded to said auto-tensioning inserts;

wherein said spring is compressed when force is applied to said flexible fencing material, maintaining tension of said flexible fencing material without permitting said flexible fencing material from breaking or becoming severed from said caged receiver; and wherein said spring supplies consistent tension to said flexible fencing material.

* * * * *